US005131119A

United States Patent [19]

Murasaki et al.

[11] Patent Number: 5,131,119

[45] Date of Patent: Jul. 21, 1992

[54] HOOK STRUCTURE FOR INTEGRALLY MOLDED SURFACE FASTENER

[75] Inventors: Ryuichi Murasaki; Hiroshi Yoshida, both of Toyama, Japan

[73] Assignee: Yoshida Kogyo K.K., Tokyo, Japan

[21] Appl. No.: 725,466

[22] Filed: Jul. 3, 1991

[30] Foreign Application Priority Data

Jul. 3, 1990 [JP] Japan ..... 2-70989[U]

[51] Int. Cl.[5] ..... A44B 18/00

[52] U.S. Cl. ..... 24/452; 24/442; 24/449

[58] Field of Search ..... 24/442, 443, 444, 445, 24/446, 447, 448, 449, 450, 451, 452, 453, 306, 587, 17 AP

[56] References Cited

U.S. PATENT DOCUMENTS

| | | | |
|---|---|---|---|
| 3,031,730 | 5/1962 | Morin | 24/452 |
| 3,261,069 | 7/1966 | Mathison | 24/452 |
| 3,312,583 | 4/1967 | Rochlis | 24/442 |
| 3,708,833 | 1/1973 | Ribich et al. | 24/450 |
| 3,879,835 | 4/1975 | Brumlik | 24/444 |
| 4,169,303 | 10/1979 | Lemelson | 24/452 |
| 4,901,204 | 2/1990 | Hayashi | 24/453 |
| 4,984,339 | 1/1991 | Provost et al. | 24/442 |

*Primary Examiner*—Victor N. Sakran

*Attorney, Agent, or Firm*—Hill, Van Santen, Steadman & Simpson

[57] ABSTRACT

Hook elements of a surface fastener can intermesh reliably with the loop elements of a companion surface fastener and can be unfastened from the loop elements very smoothly. The integrally molded hook element has softness and strength similar to those of monofilamentary hooks of a woven surface fastener.

4 Claims, 3 Drawing Sheets

HOOK STRUCTURE FOR INTEGRALLY MOLDED SURFACE FASTENER

BACKGROUND OF THE INVENTION

1. Field of the Invention

This invention relates to the structure of hook elements made of thermoplastic resin and molded integrally with a flat base of a surface fastener, and more particularly to the structure of molded hook elements having the softness and strength similar to those of monofilamentary hooks so as to improve an intermeshing force.

2. Description of the Related Art

There are currently known a variety of surface fasteners including hook elements which are made of woven and cut monofilaments. Such surface fasteners are characterized by the softness of fabrics and monofilaments, thereby assuring strong fastening with and smooth unfastening from a mating pile surface. Further, the monofilaments undergoing an elongation process have excellent tensile and bending strength even when the monofilaments are very thin. Monofilamentary hooks can be spaced very densely according to textile weave, thus causing very reliable fastening and being durable in repeated use.

Partly since materials for such woven surface fasteners are very expensive and partly since they are made through a number of manufacturing processes, it is very difficult to reduce the manufacturing cost.

To overcome the above inconveniences of the woven surface fasteners, integrally molded surface fasteners have been developed, in which hook elements integrally extend from a base by extrusion or injection molding.

Surface fasteners of the integrally molded type are disclosed in. for example, Japanese Patent Publication No. 22768/1973, Japanese Utility Model Laid-Open Publication No. 20509/1981, U.S. Pat. No. 3,312,583, Japanese Patent Laid-Open Publication No. 501775/1989.

According to Japanese Utility Model Laid-Open Publication No. 20509/1981, in production a flat base and straight projections extending from the flat base are molded integrally. Then tips of the straight projections are pressed against semi-spherical grooves on dies, being deformed according to the shape of the grooves, and being shaped as hook elements. In this case, the tips of the hook elements face random directions, thereby causing fastening force to be applied in arbitrary directions and providing very strong fastening. Partly since it is however very difficult to engage the straight projections with the grooves on the dies, and partly since the hook elements are not shaped in one process, not only the processes for making the hook elements become complicated but also respective hook elements are difficult to face desired directions and to be shaped as desired. In addition, the molded hook elements are not always uniform in shape, and are instable in intermeshing with loop elements on a companion surface fastener. Therefore the proposed surface fasteners have not yet been in practical use.

With the methods disclosed in Japanese Patent Publications No. 22768/1973 and No. 37414/1977, the base and the hook elements are integrally molded by extrusion, being shaped in succession. In production, die discs and spacers are superimposed one over another so as to obtain a mold drum. Then melted thermoplastic resin is extruded over the surface of the mold drum in rotation, being pressed into mold cavities on the die discs. The thermoplastic resin on the surface of the mold drum is compressed so as to form a base. The spacers are retracted inwardly so as to scrape a strip of surface fastener member from the surface of the mold drum. The die discs have a series of the mold cavities extending inwardly from outer side edges thereof with a predetermined spacing. The outer side edges of the spacers are smooth.

In the methods exemplified by U.S. Pat. No. 3,312,583 and Japanese Patent Laid-Open Publication No. 501775/1989, the base and the hook elements are formed integrally on a mold drum by extruding thermoplastic resin over a surface of the mold drum and into cavities of the mold drum in rotation. Then the base and hook elements are scraped from the surface of the mold drum according to the rotation of the mold drum. In these cases, the spacers are left in the mold drum. These methods and devices therefor are simplified, compared with the method of Japanese Patent Publication No. 22768/1973.

The spacers are necessary since one die disc cannot be formed with the cavities in complete conformity with the shape of the hook elements. Further, the tips of the cavities should face the circumferential of the die discs. Therefore the hook elements thus molded are directional.

To prevent the hook elements from being directional, integrally molded surface fasteners having hook elements with spherical tips is currently known.

As described above, hook elements in integrally molded surface fasteners cannot be shaped as delicately as those of woven surface fasteners. Molded hook elements do not have sufficient molecule orientation. Therefore when it is as thin as a monofilament, each hook element is too weak to be applied for practical use. The hook element should be inevitably large so as to be strong enough. In such a case, the hook elements become not only too rigid but also the number of the hook elements per unit area (density of the hooks) is reduced, resulting in weaker intermesh with loop elements of the companion fastener member. To compensate for this inconvenience, when the tips of the hook elements are made rigid, fastening and unfastening become somewhat unsmooth and stiff. In addition, the loop elements on the companion surface fastener member may be damaged, cut or worn out easily. Therefore, surface fasteners of this type are used only for installing interior finish materials for which repeated fastening and unfastening is not carried out frequently, for example.

This tendency is remarkable in the hook structure disclosed in Japanese Patent Publication No. 22768/1973. Specifically, the tips of hook elements have a cross-sectional shape of reverse triangle so as to facilitate stripping of molded surface fastener members. Therefore, the apexes of the reverse triangular tips of the hook elements intermesh with the loop elements of the companion surface fastener member, thereby causing the loop elements to be broken easily. The hook element disclosed in U.S. Pat. No. 3,312,583 is not necessarily required to be triangular in cross section, thereby reducing a possibility of breakage of the loop elements.

The integrally molded hook elements described above are very simple in cross section at their portions extending from the base, being easy to bend. When they are used repeatedly, the hook elements cannot restore their original posture, failing to intermesh with the loop elements.

Japanese Utility Model Laid-Open Publication No. 20509/1981 discloses that the tips of the hook elements are circular in cross section and are arcuate so as to assure smooth fastening and unfastening. Since they extend perpendicularly from a base, the tips of the hook elements are not only difficult to grip the loop elements but also are easily deformed at the portions where the tips of the hook elements are curved when unfastening from the loop elements. Although the hook elements are not broken, they remain deformed, thereby making the products less valuable.

SUMMARY OF THE INVENTION

It is therefore an object of this invention to provide a novel structure of hook elements which can solve the inconveniences experienced with conventional hook elements of the integrally molded surface fasteners, and more specifically to provide a structure of the hook elements which can assure smooth fastening and unfastening, very strong intermesh and reliable operation for a long period of time similarly to woven surface fasteners.

According to a first aspect of this invention, there is provided a structure of an integrally molded surface fastener in which a base and a number of hook elements extending from the base are molded integrally. The structure is characterized in that each of the hook elements includes a rear extending from the base with a gentle slope, a front extending at least partially straight from the base, and a standing portion having at least one side accompanying a reinforcing rib extending from the base and having a hook head extending forwardly therefrom, and in that a cross sectional area of the hook element is gradually increased from its head toward its root.

According to a second aspect of this invention, the forward edges of the hook heads of the hook elements arranged in a row are aligned substantially perpendicularly above sloped ends of the standing portions of adjacent hook elements.

According to a third aspect, the hook elements arranged on at least two adjacent rows are interconnected at the standing portions thereof via the reinforcing ribs.

The front of each hook element extends upright from the base while its rear is gradually sloped. The hook element has a pair of reinforcing ribs on its opposite sides. Since the sectional area of the hook element is increased gradually from its head toward its root, the whole hook element is deformed resiliently when it is unfastened from a mating loop element. In addition, since it receives unfastening force at its thickest portion, the hook element is protected against breakage, assuring smooth unfastening. The reinforcing ribs are provided so as to protect the hook element against transverse bend. When fastened, each loop element of the companion surface fastener is guided along the sloped back of one hook element, being made to intermesh an adjacent rear hook element reliably and strongly.

Specifically, when an edge of the hook head of one hook element is aligned perpendicularly above the sloped end of the hook element in front of the first-mentioned hook element, the ratio of intermesh between the hook elements and loop elements can be further increased. In addition, the hook elements on adjacent rows are interconnected via the reinforcing ribs, thereby reinforcing the portions where the hook elements extends upright from the base.

DETAILED DESCRIPTION

This invention will now be described with reference to embodiments shown in the accompanying drawings.

Figure 1:
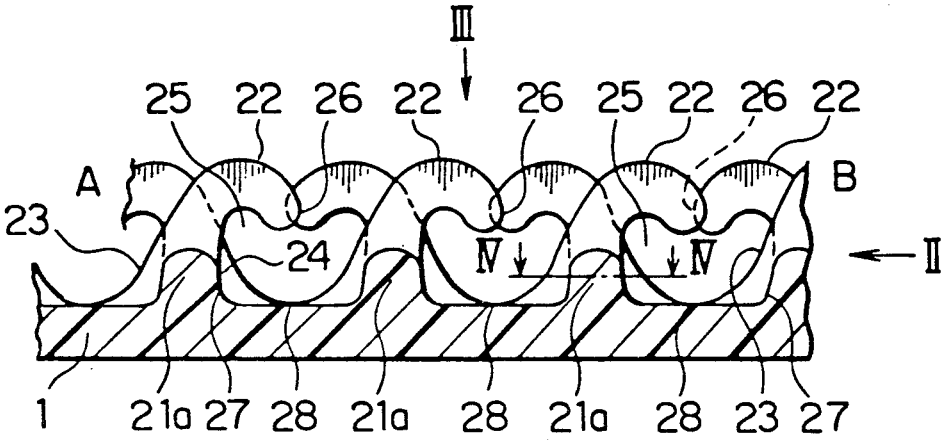
FIG. 1 is a fragmentary side elevational view, partially in cross section, showing a hook elements in an integrally molded surface fastener according to this invention.

FIG. 1 is a fragmentary side elevational view of typical hook elements of a surface fastener. In FIG. 1, reference numeral 1 stands for a flat base, on which a plurality of hook elements 2 protrude in rows. A number of rows are juxtaposed on the base 1. Two rows A and B of the hook elements are shown in FIG. 1. The hook elements on the rows A and B face opposite directions.

Both the base 1 and the hook elements 2 are made of thermoplastic resin by either extrusion or injection molding as described above.

Figure 2:
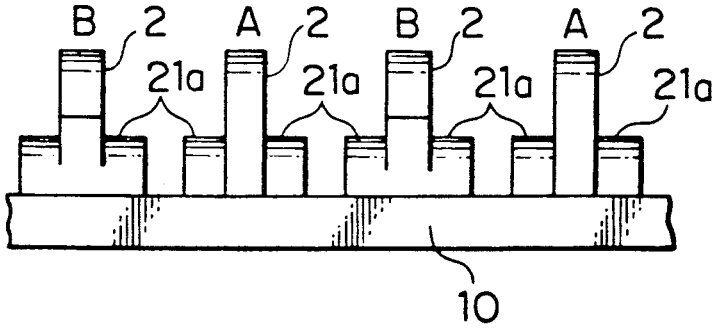
FIG. 2 is a fragmentary front elevational view of the surface fastener of FIG. 1.
Figure 3:
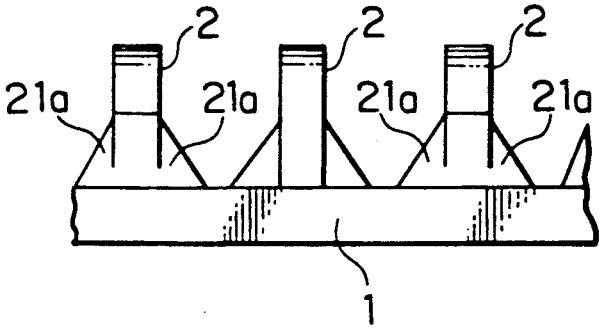
FIG. 3 is a fragmentary front elevational view of another surface fastener.
Figure 4:
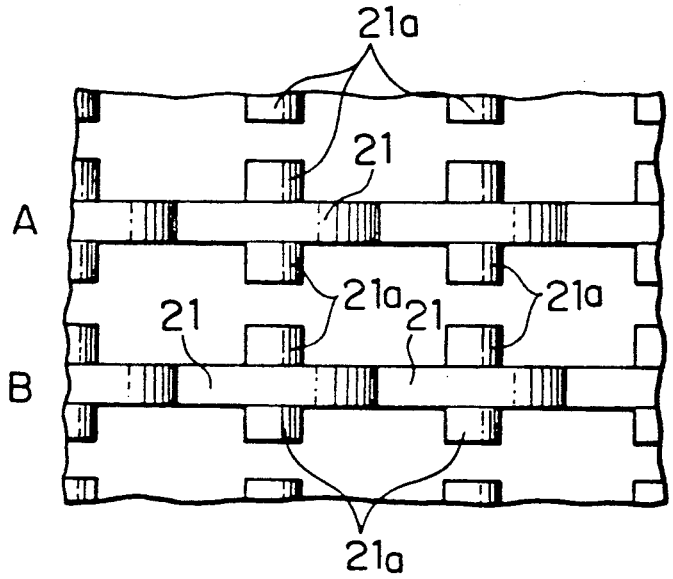
FIG. 4 is a plan view of the hook elements in the direction of the arrow III of FIG. 1.
Figure 5:
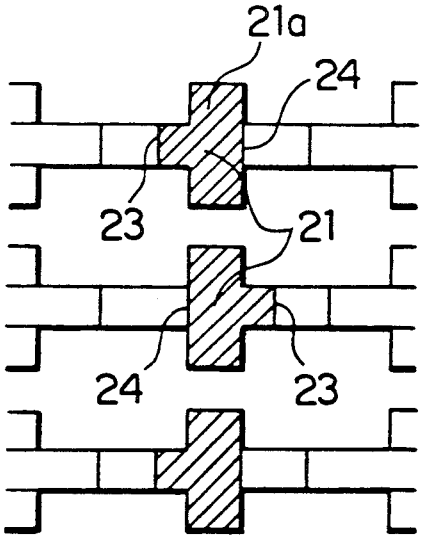
FIG. 5 is a plan view of the hook elements taken along line IV—IV of FIG. 1.

Each hook element includes a portion 21 extending from the base 1 (hereinafter referred to as a standing portion 21) and a downward hook head 22 at the forward end of the standing portion 21, looking like the crest of a wave in cross section. A back 23 of the standing portion 21, i.e. a side opposite to the hook head 22, sloping gently from the base 1. A front 24 of the hook element is rounded at its bottom, extending upright from the base 1. The standing portion 21 fans out toward the base 1 in side cross section outline. A pair of reinforcing ribs **21*a* are formed integrally with the base 1. The ribs 21*a* are shaped as desired. Typical examples of the ribs 21*a* are shown in FIGS. 2 and 3. As viewed from the front side of the hook elements, the ribs 21*a* have a substantially uniform width from the bottom to the top. The ribs 21*a* shown in FIG. 3** are tapered toward their tops.

The hook head 22 is at the forward end of the standing portion 21, forming a space 25 between its underside and the front 24. The hook head 22 is slightly tapered toward its forward edge 26. In other words, the hook element 2 is enlarged gradually from the forward edge 26 to the bottom 27 of the standing portion 21.

When the hook elements 2 of the surface fastener member are pressed to loop elements of a non-illustrated companion surface fastener, some loop elements are guided along the sloped backs 23 of the hook elements while some loop elements are guided to the forward edges 26 of the hook heads 22. The former loop elements intermesh the hook heads 22 of the hook elements 2 adjacent to the sloped backs 23. The latter loop elements grip the hook heads 22. In either case, the hook elements 2 and the loop elements of the surface fasteners fasten reliably one another. In the embodiment shown in FIG. 1, the forward edge 26 of the hook head 22 of one hook element and the end of the sloped back 23 of an adjacent hook element are aligned substantially along the same perpendicular line, thereby enabling the hook elements and the loop elements to intermesh further reliably.

The reinforcing ribs 21*a* prevent the hook elements from bending transversely when the hook elements are pressed to the loop elements repeatedly.

Since each hook head 22 is tapered toward its forward edge so as to be flexible, each hook element can be unfastened from the loop element smoothly. In addition, the above-mentioned structure of the standing portion 21 enables the hook element to absorb at its bottom an excessive unfastening force applied to the hook head 22, thereby allowing the standing portion 21 to regain its original posture resiliently, and releasing quickly the loop element from the hook head 22.

Figure 6:
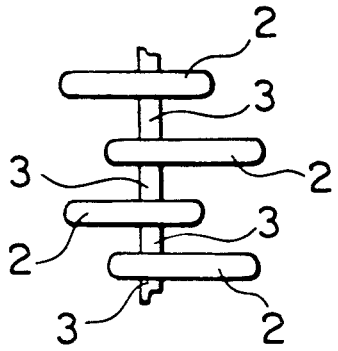
FIG. 6 is a plan view of the modified surface fastener of FIG. 4.

FIG. 6 shows an example of a modified hook element 2 whose standing portion is lengthened. Since such hook elements 2 tend to bend transversely, standing portions of the hook elements 2 in adjacent rows A and B are interconnected by reinforcing ribs 3, 3 as shown in FIG. 6. This example differs from those described above in this point. The ribs 3, 3 assist in reinforcing the standing portions as a whole. Therefore it is possible to thin the other parts of the hook elements, thereby making it possible to space the hook elements more densely. The surface fastener thus formed become more similar to the woven surface fasteners.

Figure 7:
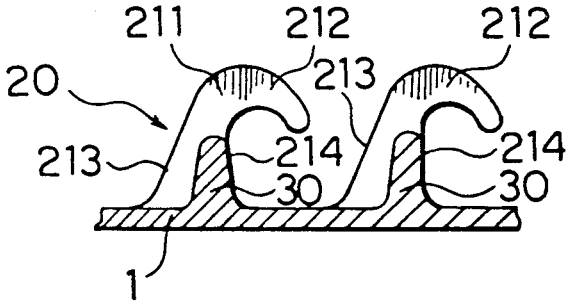
FIG. 7 is a fragmentary side elevational view of another modification of the surface fastener.
Figure 8:
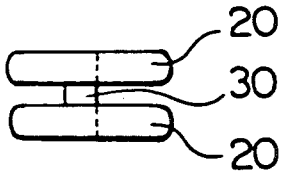
FIG. 8 is a plan view of the modification of the surface fastener of FIG. 7.

In an example shown in FIGS. 7 and 8, the standing portions 211 except for the backs 213 are straight, the ribs 30 are made tall, and a space between adjacent two hook elements 20, 20 is narrowed. This is because the hook elements can be thinned due to existence of the reinforcing ribs 30. Therefore the hook elements can be spaced closely, allowing the hook heads 212 to intermesh with the loop elements more easily. Even when the front 214 of the standing portion 211 is straight, the hook head 212 will not be damaged or broken.

The hook elements having the structure described above can intermesh reliably with the loop elements of a companion surface fastener element reliably, and can be unfastened from the loop elements very smoothly. The entire hook element can receive resiliently instant forces applied at the time of fastening and unfastening, being protected against breakage. The reinforcing ribs enable the hook elements to be used reliably and repeatedly. Further, the surface fasteners according to this invention can fasten and unfasten smoothly the mating loop elements similar to woven surface fasteners. When the standing portions of the hook elements in adjacent rows are interconnected via the reinforcing ribs, the hook elements can be not only strengthened but also be thinned, so that the hook elements can be spaced densely, enabling easy and reliable intermesh with the loop elements of the companion surface fastener. The integrally molded surface fastener according to this invention can function in a manner similar to woven surface fasteners.

What is claimed is:

1. An integrally molded surface fastener member for hook and loop fasteners comprising:

(a) a flat base, and (b) a plurality of hook elements extending from said flat base, each hook element including (i) a rear portion extending from said flat base with a gentle slope, (ii) a front portion extending at least partially straight from said flat base, (iii) a standing portion having at least one side accompanying a reinforcing rib extending from said flat base, and (iv) a hook head extending forwardly from said standing portion, each said hook element having a varying cross sectional area increasing gradually from said hook head toward said flat base.

2. An integrally molded surface fastener member according to claim 1, wherein forward edges of said hook heads of said hook elements arranged in a row are aligned substantially perpendicularly above sloped ends of said standing portions of adjacent hook elements.

3. An integrally molded surface fastener member according to claim 1, wherein said hook elements arranged on at least two adjacent rows are interconnected at said standing portions thereof via said reinforcing ribs.

4. An integrally molded surface fastener member according to claim 1, wherein each said reinforcing rib has a varying cross sectional area increasing gradually from said hook head toward said flat base.

* * * * *